US010586648B2

(12) United States Patent
Lee et al.

(10) Patent No.: US 10,586,648 B2
(45) Date of Patent: Mar. 10, 2020

(54) COIL COMPONENT AND METHOD FOR MANUFACTURING THE SAME

(71) Applicant: SAMSUNG ELECTRO-MECHANICS CO., LTD., Suwon-si, Gyeonggi-do (KR)

(72) Inventors: Sang Jae Lee, Suwon-si (KR); Youn Soo Seo, Suwon-si (KR); Jae Ha Kim, Suwon-si (KR); Hye Yeon Cha, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 88 days.

(21) Appl. No.: 15/784,633

(22) Filed: Oct. 16, 2017

(65) Prior Publication Data

US 2018/0268988 A1 Sep. 20, 2018

(30) Foreign Application Priority Data

Mar. 16, 2017 (KR) ..... 10-2017-0033180

(51) Int. Cl.
*H01F 27/28* (2006.01)
*H01F 41/12* (2006.01)
(Continued)

(52) U.S. Cl.
CPC ..... *H01F 27/2804* (2013.01); *H01F 17/0013* (2013.01); *H01F 27/24* (2013.01);
(Continued)

(58) Field of Classification Search
CPC .... H01F 27/2804; H01F 27/327; H01F 27/24; H01F 27/323; H01F 27/324;
(Continued)

(56) References Cited

U.S. PATENT DOCUMENTS 6,996,892 B1 * 2/2006 Dening ..... H01F 17/0013 29/602.1
9,129,733 B2 * 9/2015 Sato ..... H01F 17/0013
(Continued)

FOREIGN PATENT DOCUMENTS

JP H07-022251 A 1/1995
JP H07-142256 A 6/1995
(Continued)

OTHER PUBLICATIONS

Notice of Office Action issued in Japanese Patent Application No. 2017-200650, dated Sep. 4, 2018 (English translation).

*Primary Examiner* — Mang Tin Bik Lian
(74) *Attorney, Agent, or Firm* — Morgan, Lewis & Bockius LLP

(57) ABSTRACT

A coil component includes a body portion including a magnetic material, and a coil portion disposed in the body part. The coil portion includes a first coil pattern layer having a planar spiral pattern, an insulating layer formed of an insulating resin embedding at least a portion of the first coil pattern layer, and a second coil pattern layer disposed on the insulating layer and having a planar spiral pattern. The insulating layer includes a core material disposed between the first and second coil pattern layers, and a thickness of a lower region of the insulating layer disposed below the core material is greater than a thickness of an upper region of the insulating layer disposed above the core material.

26 Claims, 12 Drawing Sheets

(51) Int. Cl.
*H01F 41/04* (2006.01)
*H01F 27/32* (2006.01)
*H01F 27/24* (2006.01)
*H01F 17/00* (2006.01)

(52) U.S. Cl.
CPC ..... *H01F 27/327* (2013.01); *H01F 41/041* (2013.01); *H01F 41/046* (2013.01); *H01F 41/127* (2013.01); *H01F 2017/0066* (2013.01); *H01F 2027/2809* (2013.01)

(58) Field of Classification Search
CPC ..... H01F 17/0006; H01F 2027/2809; H01F 41/127; H01F 41/041; H01F 41/046
USPC ..... 336/200, 223, 233; 29/602.1, 605, 606
See application file for complete search history.

(56) References Cited

U.S. PATENT DOCUMENTS

2005/0140488 A1 6/2005 Shimoyama et al.
2009/0052214 A1* 2/2009 Edo ..... H01F 27/2804 363/123
2013/0216855 A1 8/2013 Nagaura et al.
2014/0002226 A1* 1/2014 Moon ..... H01F 41/125 336/200
2014/0145812 A1 5/2014 Lee et al.
2014/0184374 A1* 7/2014 Park ..... H01F 27/255 336/83
2014/0327335 A1* 11/2014 Mabuchi ..... H01F 5/06 310/208
2015/0035634 A1 2/2015 Nakamura et al.
2015/0048918 A1 2/2015 Park et al.
2016/0064319 A1* 3/2016 Suzuki ..... H01L 23/49827 174/251
2016/0086721 A1* 3/2016 Park ..... H01F 27/2804 336/200
2016/0293320 A1 10/2016 Kim et al.
2016/0379750 A1 12/2016 Hamada et al.

FOREIGN PATENT DOCUMENTS

JP 2002-110425 A 4/2002
JP 2002-124415 A 4/2002
JP 2005-191408 A 7/2005
JP 2014-107548 A 6/2014
JP 2015-032625 A 2/2015
JP 2015-037189 A 2/2015
JP 2016-197712 A 11/2016
JP 2017-011185 A 1/2017
JP 62-80304 U 2/2018
WO 2013031913 A1 3/2013

* cited by examiner

COIL COMPONENT AND METHOD FOR MANUFACTURING THE SAME

CROSS-REFERENCE TO RELATED APPLICATION

This application claims the benefit of priority to Korean Patent Application No. 10-2017-0033180, filed on Mar. 16, 2017 with the Korean Intellectual Property Office, the entirety of which is incorporated herein by reference.

BACKGROUND

The present disclosure relates to a coil component and a method for manufacturing the same, for example to a power inductor and a method for manufacturing the same.

In accordance with the miniaturization and thinning of electronic devices such as digital televisions, mobile phones, laptop computers, and the like, the miniaturization and thinning of coil components used in such electronic devices have been demanded. In order to satisfy such demand, research into and development of various winding type or thin film type coil components has been actively conducted.

Furthermore, support members for use with thin film technology are generally required to have a certain minimum thickness to maintain their rigidity. However, to provide the minimum thickness of the support member within a package of a given size, the thickness of a magnetic material covering a coil is reduced, thus being limited to providing high permeability (Ls).

SUMMARY

An aspect of the present disclosure may provide a coil component that may maintain improved rigidity, while ensuring a sufficiently low thickness of a magnetic material covering a coil, regardless of miniaturization and thinning of the coil component, and a method for manufacturing the coil component.

One solution proposed by the present disclosure is to form a coil including a plurality of coil pattern layers having a planar spiral pattern, using an insulating layer having upper and lower regions having different thicknesses, based on a core material disposed inside the coil.

According to an aspect of the present disclosure, a coil component may include a body portion including a magnetic material and a coil portion disposed in the body part. The coil portion may include a first coil pattern layer having a planar spiral pattern, an insulating layer formed of an insulating resin embedding at least a portion of the first coil pattern layer, and a second coil pattern layer disposed on the insulating layer and having a planar spiral pattern. The insulating layer may include a core material disposed between the first and second coil pattern layers. A thickness of a lower region of the insulating layer disposed below the core material may be greater than a thickness of an upper region of the insulating layer disposed above the core material.

According to an aspect of the present disclosure, a method for manufacturing a coil component may include providing a substrate including a support layer having a first metal layer and a second metal layer sequentially disposed thereon. A first coil pattern layer having a planar spiral pattern is formed on the second metal layer of the substrate, and an insulating layer is formed on the second metal layer of the substrate, the insulating layer embedding at least a portion of the first coil pattern layer. A second coil pattern layer having a planar spiral pattern is formed on the insulating layer. The first metal layer is separated from the second metal layer having the first coil pattern layer, the insulating layer, and the second coil pattern layer thereon. The second metal layer is removed from the first coil pattern layer, the insulating layer, and the second coil pattern layer. The first coil pattern layer, the second coil pattern layer, and the insulating layer are enclosed with a magnetic material. The insulating layer may include a core material disposed between the first and second coil pattern layers. A thickness of a lower region of the insulating layer disposed below the core material may be greater than a thickness of an upper region of the insulating layer disposed above the core material.

According to an aspect of the present disclosure, a coil component includes a first coil pattern layer having a planar spiral pattern, an insulating layer having the first coil pattern layer embedded therein, and a second coil pattern layer having a planar spiral pattern. The insulating layer includes insulating resin having a core material disposed therein extending in a plane substantially parallel to the planar spiral pattern. The second coil pattern layer is disposed on a surface of the insulating layer to be substantially parallel to the planar spiral pattern.

According to a further aspect of the present disclosure, a coil component includes an insulating layer formed of an insulating resin and having a substantially planar core material embedded therein, and first and second coil pattern layers. The first coil pattern layer is disposed on a first side of the core material, has a planar spiral pattern, and is embedded in the insulating layer to have the insulating resin extending between windings of the planar spiral pattern. The second coil pattern layer has a planar spiral pattern disposed on a surface of the insulating layer on a second side of the core material opposite to the first side.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
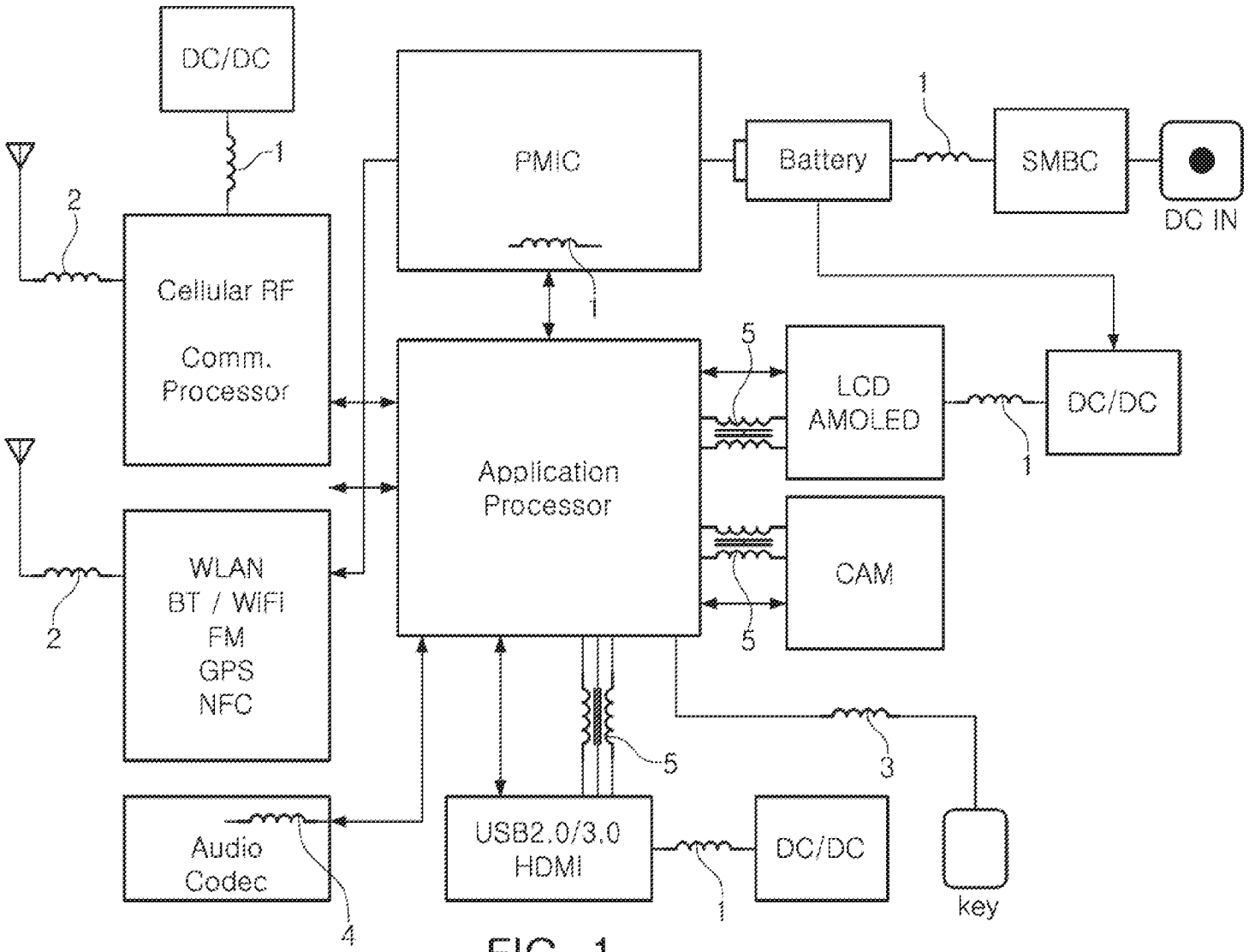
FIG. 1 illustrates schematic examples of coil components used in electronic devices.

Hereinafter, embodiments of the present disclosure will be described with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region, or wafer (substrate), is referred to as being "on," "connected to," or "coupled to" another element, it can be directly "on," "connected to," or "coupled to" the other element, or other elements intervening therebetween may be present. In contrast, when an element is referred to as being "directly on," "directly connected to," or "directly coupled to" another element, there may be no other elements or layers intervening therebetween. Like numerals refer to like elements throughout. As used herein, the term "and/or" includes any and all combinations of one or more of the associated, listed items.

It will be apparent that, although the terms 'first,' 'second,' 'third,' etc. may be used herein to describe various members, components, regions, layers, and/or sections, these members, components, regions, layers, and/or sections should not be limited by these terms. These terms are only used to distinguish one member, component, region, layer, or section from another member, component, region, layer, or section. Thus, a first member, component, region, layer, or section discussed below could be termed a second member, component, region, layer, or section without departing from the teachings of the exemplary embodiments.

Spatially relative terms, such as "above," "upper," "below," "lower," or the like, may be used herein for ease of description to describe one element's positional relationship relative to other element(s) in the orientation illustratively shown in the figures. It will be understood that spatially relative terms are intended to encompass different orientations of the device in use or operation, in addition to the orientation depicted in the figures. For example, if the device in the figures is turned over, elements described as "above" or "upper" relative to other elements would then be oriented "below" or "lower" relative to the other elements or features. Thus, the term "above" can encompass both the above and below orientations, depending on a particular directional orientation of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example due to manufacturing techniques and/or tolerances, modifications of the shape shown may be estimated. Thus, embodiments of the present disclosure should not be construed as being limited to the particular shapes of regions shown herein but should more generally be understood to include a change in shape resulting from manufacturing processes, fabrication tolerances, and other variations. The following embodiments may also be constituted alone or as a combination of several or all thereof.

The contents of the present disclosure described below may have a variety of configurations, and only a required configuration is proposed herein, but the present disclosure is not limited thereto.

Electronic Device

FIG. 1 illustrates a schematic example of a coil component used in an electronic device.

Referring to FIG. 1, various types of electronic components may be used in an electronic device, such as a direct current/direct current (DC/DC) device, a communications (Comm.) processor, a wireless local area network (WLAN) device, a Bluetooth (BT) device, a Wi-Fi device, a frequency modulation (FM) device, a global positioning system (GPS) device, a near field communication (NFC) device, a power management integrated circuit (PMIC), a battery, a switched-mode battery charger (SMBC), a liquid crystal display (LCD), an active-matrix organic light-emitting diode (AMOLED), an audio codec, a universal serial bus (USB) 2.0/3.0 device, a high-definition multimedia interface (HDMI), or a camera or webcam (CAM), using an application processor as a primary part. In this case, various types of coil components may be properly adopted in spaces and connections between these electronic components to remove noise or the like according to uses. For example, a coil component such as a power inductor 1, a high frequency (HF) inductor 2, a general bead 3, a high frequency (GHz) bead 4, or a common mode filter 5 can be used.

In detail, the power inductor 1 may be used to store electricity in magnetic field form to maintain an output voltage, thus stabilizing power. In addition, the HF inductor 2 may be used to perform impedance matching to secure a required frequency or to cut off noise and/or an alternating current (AC) component. Further, the general bead 3 may be used to remove noise of power and signal lines or remove a high frequency ripple. Further, the GHz bead 4 may be used to remove high frequency noise of a signal line related to audio signals and a power line. Further, the common mode filter 5 may be used to pass a current therethrough in a differential mode and remove only common mode noise.

The electronic device may be a typical smartphone, but is not limited thereto. For example, the electronic device may be a personal digital assistant, a digital video camera, a digital still camera, a network system, a computer, a monitor, a television, a video game console, or a smart watch. The electronic device may also be of various other types in addition to the devices described above.

Coil Component

A coil component, according to an exemplary embodiment, will be described hereinafter. For convenience of explanation, an inductor, specifically a structure of a power inductor, is described as an example. However, the teachings herein may be applied to other coil components types having various different purposes described above.

Meanwhile, a lateral portion as used below may refer to a portion disposed in a first direction or a second direction, an upper portion as used below may refer to a portion disposed in a third direction, and a lower portion as used below may refer to a portion disposed in a direction opposite to the third direction, for convenience of explanation. Further, locating a component on the lateral portion, the upper portion, or the lower portion may include providing a direct contact between the component and the referenced portion and providing an indirect contact therebetween. However, even when this description defines a direction for convenience of description, the scope of the claims is not limited to descriptions of the direction.

Figure 2:
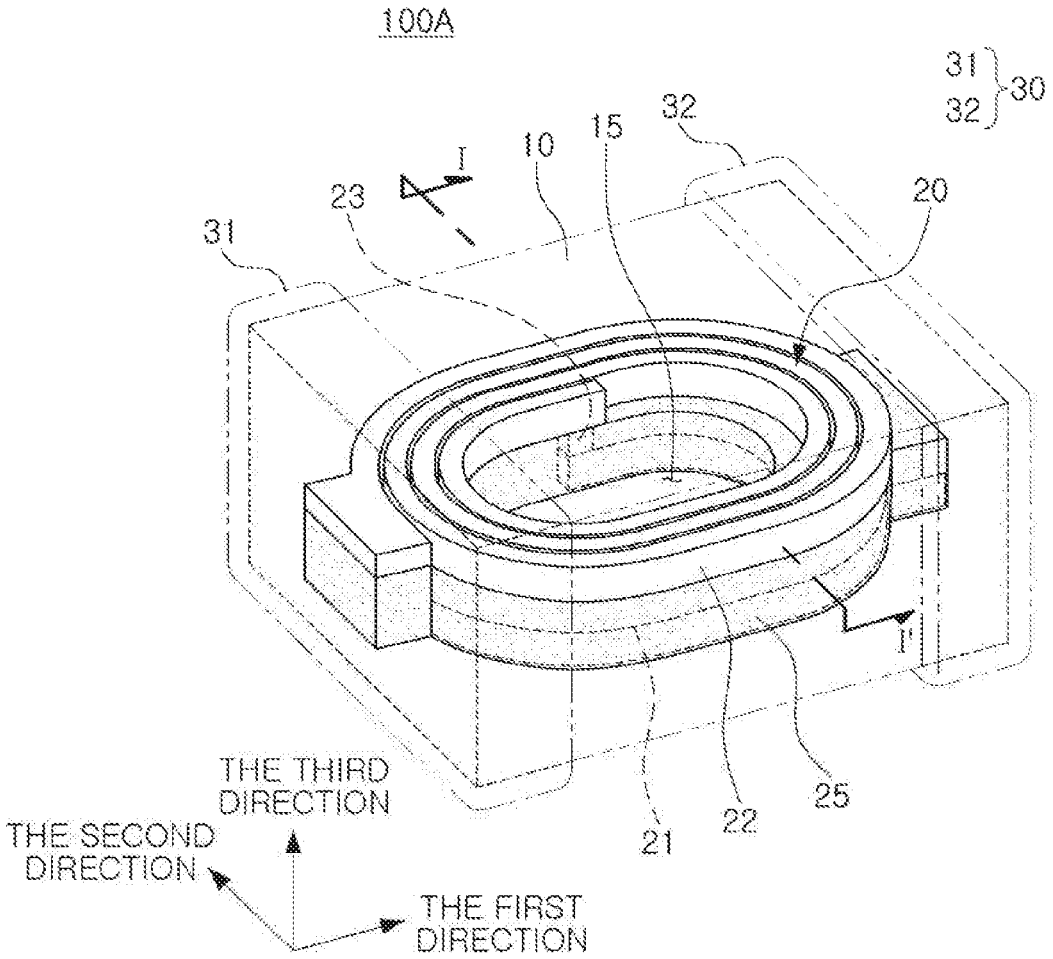
FIG. 2 is a schematic projected perspective view illustrating an example of a coil component.

FIG. 2 is a schematic projected perspective view illustrating an example of a coil component 100A.

Figure 3:
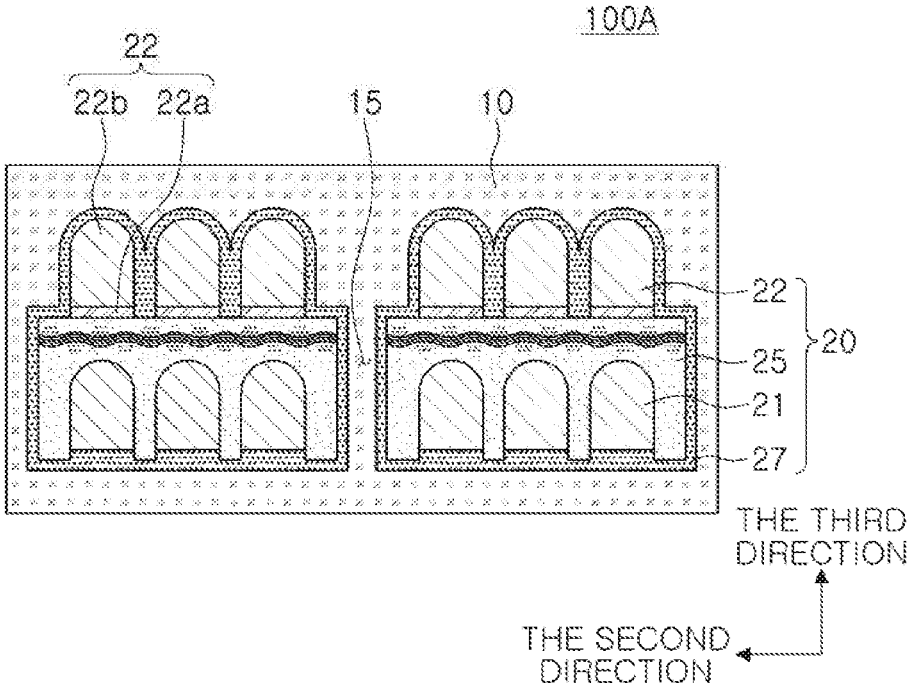
FIG. 3 is a schematic cross-sectional view of the coil component of FIG. 2 taken along line I-I'.

FIG. 3 is a schematic cross-sectional view of the coil component 100A taken along line I-I' of FIG. 2.

Figure 4:
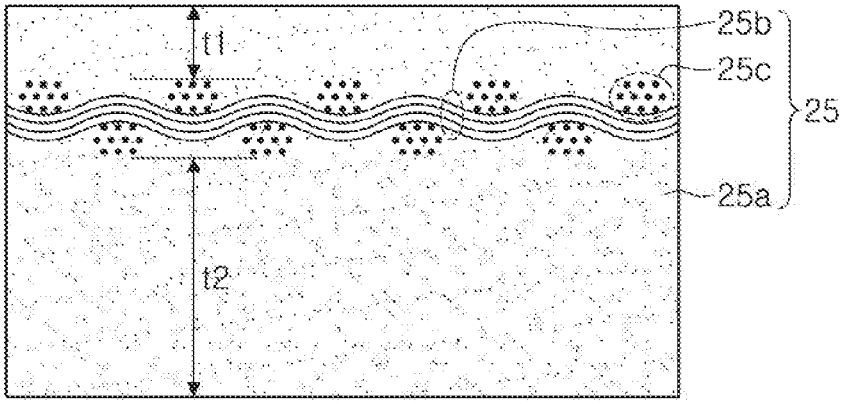
FIG. 4 is a schematic enlarged cross-sectional view of an insulating layer of the coil component of FIG. 3.

FIG. 4 is a schematic enlarged cross-sectional view of an insulating layer of the coil component 100A of FIG. 3.

Referring to FIGS. 2 through 4, the coil component 100A, according to an exemplary embodiment, may include a body portion 10, including a magnetic material, a coil portion 20 disposed in the body portion 10, and an electrode portion 30 disposed on the body portion 10. The coil portion 20 may include, as essential components, a first coil pattern layer 21 having a planar spiral pattern, an insulating layer 25 embedding at least a portion of the first coil pattern layer 21, and a second coil pattern layer 22 disposed on the insulating layer 25 and having a planar spiral pattern. The insulating layer 25 may include a core material 25*b* other than an insulating resin 25*a*, and based on the core material 25*b*, a thickness t2 of a lower region of the insulating layer 25 may be greater than a thickness t1 of an upper region of the insulating layer 25. The first coil pattern layer 21 may be embedded in the lower region of the insulating layer 25, and the second coil pattern layer 22 may be disposed on the upper region of the insulating layer 25.

Recently, as mobile devices are being configured for increased numbers of functions, power consumption thereof has increased. To stem the increase in power consumption, low-loss passive components having improved efficiency may be employed on a periphery of a PMIC included in the mobile device to increase battery lifetime thereof. Among such passive components, a small, low-profile power inductor that may reduce a product size and increase battery capacity due to having improved efficiency may be preferred. As the power inductor is miniaturized and implemented with high efficiency, the size of a chip is reduced. Increasing a volume or permeability of a magnetic body surrounding a coil may be advantageous in providing high capacity within a limited volume of the power inductor.

Generally, a laminated plate may be used in a thin-film power inductor used as the power inductor. The laminated plate may have a resin layer, referred to as a copper clad laminate (CCL), whose opposing surfaces are coated with a copper foil. The coil may be implemented to have a vertically symmetrical structure with the CCL as a center. In the case of using the CCL, when a circuit formation and plating process for the coil is completed, the coil may be compressed with the magnetic body to form the chip. A thickness of the CCL may limit the amount of the magnetic body that can be charged within the limited volume of the chip. Thus, it may be difficult to improve a certain degree or more of efficiency. When the thickness of the CCL is reduced, the rigidity of materials may be degraded. Thus, it may be difficult to normally use a horizontal line of a substrate process. For example, the materials may be bent to be rolled on a roll, thereby being damaged, and the risk of damage to products may also be increased during movements of the materials between processes.

In contrast, the coil component 100A may have no support member for forming a coil, unlike a thin-film power inductor according to the related art. Instead of using the support member, the coil component 100A may have the insulating layer 25, including the core material 25*b*, to provide support thereto. Here, the thickness t2 of the lower region of the insulating layer 25 may be greater than the thickness t1 of the upper region of the insulating layer 25. The insulating layer 25 may embed at least a portion of the first coil pattern layer 21. Further, the second coil pattern layer 22 may be formed on the first coil pattern layer 21. The first coil pattern layer 21 may be embedded in the lower region of the insulating layer 25, and the second coil pattern layer 22 may be disposed on the upper region of the insulating layer 25. The coil portion 20, having such an arrangement, may have a significantly reduced thickness thereof itself. Thus, a significantly increased volume can be occupied by the magnetic material of the body portion 10 surrounding the coil portion 20. As a result, high capacity may be easily provided. In particular, the insulating layer 25 may include the core material 25*b*, as well as the insulating resin 25*a*, similarly to the CCL, and the core material 25*b* may maintain the rigidity of the coil portion 20 between the first coil pattern layer 21 and the second coil pattern layer 22, thus preventing warpage or the like.

The components of the coil component 100A, according to an exemplary embodiment, will be further detailed hereinafter with reference to the drawings.

The body portion 10 may form an exterior of the coil component 100A, and may include a first surface and a second surface opposing each other in the first direction, a third surface and a fourth surface opposing each other in the second direction, and a fifth surface and a sixth surface opposing each other in the third direction. The body portion 10 may be hexahedral as described above, but is not limited thereto. The body portion 10 may include the magnetic material. The magnetic material may cover an upper portion and a lower portion of the coil portion 20, and may fill a core 15 formed in a central portion of the coil portion 20. The magnetic material may increase the characteristics of the coil (e.g., increase the inductance of the coil).

The magnetic material is not particularly limited as long as it has magnetic properties, and for example, may include Fe alloys such as a pure iron powder, an Fe—Si-based alloy powder, an Fe—Si—Al-based alloy powder, an Fe—Ni-based alloy powder, an Fe—Ni—Mo-based alloy powder, an Fe—Ni—Mo—Cu-based alloy powder, an Fe—Co-based alloy powder, an Fe—Ni—Co-based alloy powder, an Fe—Cr-based alloy powder, an Fe—Cr—Si-based alloy powder, an Fe—Ni—Cr-based alloy powder, or an Fe—Cr—Al-based Fe alloy, amorphous alloys such as an Fe-based amorphous alloy and a Co-based amorphous alloy, spinel-type ferrites such as a Mg—Zn-based ferrite, a Mn—Zn-based ferrite, a Mn—Mg-based ferrite, a Cu—Zn-based ferrite, a Mg—Mn—Sr-based ferrite, and a Ni—Zn-based ferrite, hexagonal ferrites such as a Ba—Zn-based ferrite, a Ba—Mg-based ferrite, a Ba—Ni-based ferrite, a Ba—Co-based ferrite, and a Ba—Ni—Co-based ferrite, or garnet-type ferrites such as a Y-based ferrite and the like.

The magnetic material may include magnetic metal powder particles and a binder resin. The magnetic metal powder particles may include iron (Fe), chromium (Cr), and/or silicon (Si) as a main ingredient. For example, the magnetic metal powder particles may include iron-nickel (FeNi), iron (Fe), iron-chromium-silicon (FeCrSi), or the like, but are not limited thereto. The binder resin may include an epoxy, a polyimide, a liquid crystal polymer (LCP), or a mixture thereof, but is not limited thereto. The magnetic metal powder particles may have at least two average particle diameters. The body portion may be formed using the magnetic metal powder particles, having different average particle diameters, so that the body portion may have a significantly reduced gap, thus increasing a packing factor. As a result, the characteristics (e.g., inductance) of the coil may be increased.

The coil portion 20 may be provided to exhibit the characteristics of the coil component 100A, which may perform various functions within the electronic device, using the characteristics exhibited by the coil of the coil portion 20. For example, the coil component 100A may be the power inductor as mentioned above. In this case, the coil may store electricity in magnetic field form to maintain an output voltage, thus stabilizing power. The coil portion 20 may further include a via 23, electrically connecting the first coil pattern layer 21 to the second coil pattern layer 22 while passing through the insulating layer 25. The coil portion 20 may additionally include an insulating film 27 filling a space between portions of the planar spiral pattern of the second coil pattern layer 22 while covering an upper surface and a side surface of the second coil pattern layer 22. The coil portion 20 may also include the first coil pattern layer 21, the insulating layer 25, and the second coil pattern layer 22 described above.

The first coil pattern layer 21 may have a planar spiral pattern including a plurality of turns. The planar spiral pattern of the first coil pattern layer 21 may be formed of a known conductive material, such as copper (Cu), aluminum (Al), silver (Ag), tin (Sn), gold (Au), nickel (Ni), lead (Pb), titanium (Ti), or alloys thereof. The first coil pattern layer 21 may include a plating layer without having a seed layer. The seed layer of the first coil pattern layer 21 may be removed using an etching process in a manufacturing process. For example, the first coil pattern layer 21 may include only the plating layer. The plating layer may include a single layer or a plurality of layers. A lower surface of the first coil pattern layer 21 may be stepped from a lower surface of the insulating layer 25. For example, the lower surface of the first coil pattern layer 21 may be recessed upwardly, based on the lower surface of the insulating layer 25. The lower surface of the first coil pattern layer 21 may be exposed from the lower surface of the insulating layer 25, and the exposed lower surface of the first coil pattern layer 21 may be covered by the insulating film 27. Across-sectional shape of the planar spiral pattern of the first coil pattern layer 21 is not limited to those illustrated in the drawings, and may also change into other various shapes, according to a plating method.

The second coil pattern layer 22 may also have the planar spiral pattern having a plurality of turns. The planar spiral pattern of the second coil pattern layer 22 may also be formed of a known conductive material, such as copper (Cu), aluminum (Al), silver (Ag), tin (Sn), gold (Au), nickel (Ni), lead (Pb), titanium (Ti), or alloys thereof. The second coil pattern layer 22 may include a seed layer 22*a* and a plating layer 22*b*. The seed layer 22*a* and the plating layer 22*b* may include a single layer or a plurality of layers. The seed layer 22*a* and the plating layer 22*b* may include the above-mentioned conductive material. As a non-limiting example, both the seed layer 22*a* and the plating layer 22*b* may include copper (Cu), but are not limited thereto. The seed layer 22*a* and the plating layer 22*b* may have distinct boundaries, depending on a manufacturing process. The upper surface and the side surface of the second coil pattern layer 22 may be covered by the insulating film 27. Further, the space between the portions of the planar spiral pattern of the second coil pattern layer 22 may be filled with the insulating film 27. A cross-sectional shape of the planar spiral pattern of the second coil pattern layer 22 is not limited to those illustrated in the drawings, and may also change into other various shapes, according to a plating method used.

The via 23 may pass or extend through the insulating layer 25, and may electrically connect the first coil pattern layer 21 to the second coil pattern layer 22. The via 23 may be formed of a known conductive material, such as copper (Cu), aluminum (Al), silver (Ag), tin (Sn), gold (Au), nickel (Ni), lead (Pb), titanium (Ti), or alloys thereof. A shape of the via 23 may be any known shape, such as a cylindrical shape, a tapered shape, and the like, but is not limited thereto. The via 23 may be formed together with the second coil pattern layer 22 when the second coil pattern layer 22 is formed. Thus, the via 23 may be formed integrally with the second coil pattern layer 22. However, the present disclosure is not limited thereto. The via 23 may also include one or a plurality of layers, including a seed layer and a plating layer.

The insulating layer 25 may include the insulating resin 25*a* and the core material 25*b*. The insulating resin 25*a* may be a thermosetting resin, such as an epoxy resin, or a thermoplastic resin, such as a polyimide, but is not limited thereto. The core material 25*b* may be a fibrous material, such as a glass fiber, that may maintain rigidity, but is not limited thereto. The core material 25*b* may retain the rigidity of the coil portion 20. As a result, warpage may be significantly reduced in the manufacturing process. As to the insulating layer 25, the thickness t2 of the lower region of the insulating layer 25 (e.g., a region of the insulating layer 25 that is disposed below the core material 25*b*) may be greater than the thickness t1 of the upper region of the insulating layer 25 (e.g., a region of the of the insulating layer 25 that is disposed above the core material 25*b*), based on the core material 25*b*. Thus, the first coil pattern layer 21 may be easily embedded in the lower region of the insulating layer 25 (e.g., embedded only in the lower region of the insulating layer 25 so as not to contact or extend into the upper region thereof), and an overall thickness of the coil portion 20 may be significantly reduced. The insulating layer 25 may further include an inorganic filler 25*c*, in addition to the insulating resin 25*a* and the core material 25*b*. Presence of the inorganic filler 25*c* may enable a coefficient of thermal expansion or the like to be controlled. For example, an unbalanced prepreg (PPG), having an asymmetric structure, may be used as the insulating layer 25. The insulating film 27 may cover at least a portion of each of an upper surface, a side surface, and a lower surface of the insulating layer 25.

The insulating film 27 may cover the upper surface and the side surface of the first coil pattern layer 21, and may fill a space between adjacent portions of the planar spiral pattern of the first coil pattern layer 21. Further, the insulating film 27 may cover the at least a portion of each of the upper surface, the side surface, and the lower surface of the insulating layer 25. Further, the insulating layer 27 may cover the at least a portion of the lower surface of the first coil pattern layer 21. Here, the insulating layer 27 may fill a recessed region of the lower surface of the first coil pattern layer 21. The insulating film 27 may include a known insulating material that may be used in an insulating coating process.

The electrode portion 30 may electrically connect the coil component 100A to the electronic device when the coil component 100A is mounted in the electronic device. The electrode portion 30 may include a first electrode 31 and a second electrode 32 spaced apart from each other on the body portion 10. The first and second electrodes 31 and 32 may cover the first and second surfaces of the body portion 10, opposing each other in the first direction, and may extend to the third through sixth surfaces that are each adjacent to (or connected to) the first and second surfaces of the body portion 10. The first and second electrodes 31 and 32 may be electrically connected to first and second lead terminals (not illustrated) of the coil portion 20, respectively, on the first and second surfaces of the body portion 10. However, an arrangement of the first and second electrodes 31 and 32 is not limited thereto.

The first and second electrodes 31 and 32 may each include, for example, a conductive resin layer, and a conductive layer formed on the conductive resin layer. The conductive resin layer may include at least one conductive metal selected from the group consisting of copper (Cu), nickel (Ni), and silver (Ag), and a thermosetting resin. The conductive layer may include at least one selected from the group consisting of nickel (Ni), copper (Cu), and tin (Sn), and for example, a nickel (Ni) layer and a tin (Sn) layer may be sequentially formed in the conductive layer. However, the present disclosure is not limited thereto.

Figure 5A:
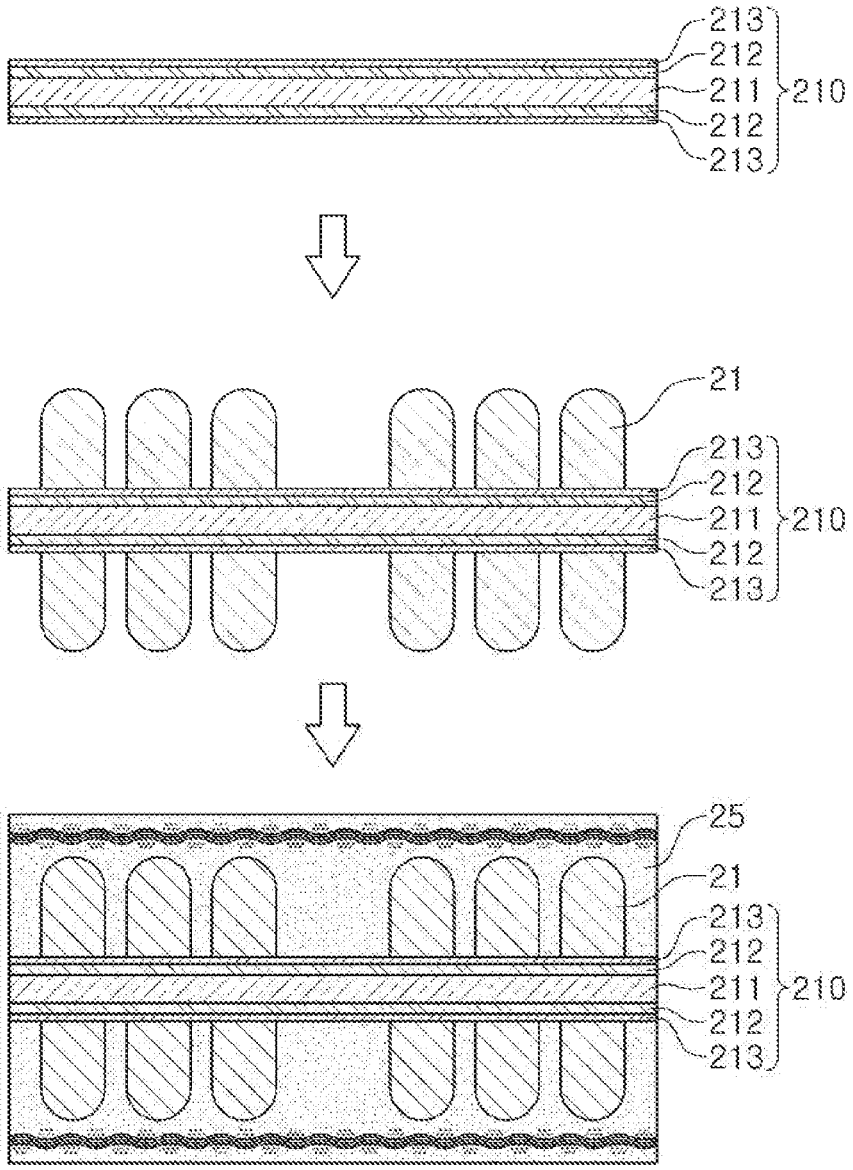
FIGS. 5A through 5C are schematic views illustrating sequential steps of a method for manufacturing the coil component illustrated in FIG. 3.
Figure 5B:
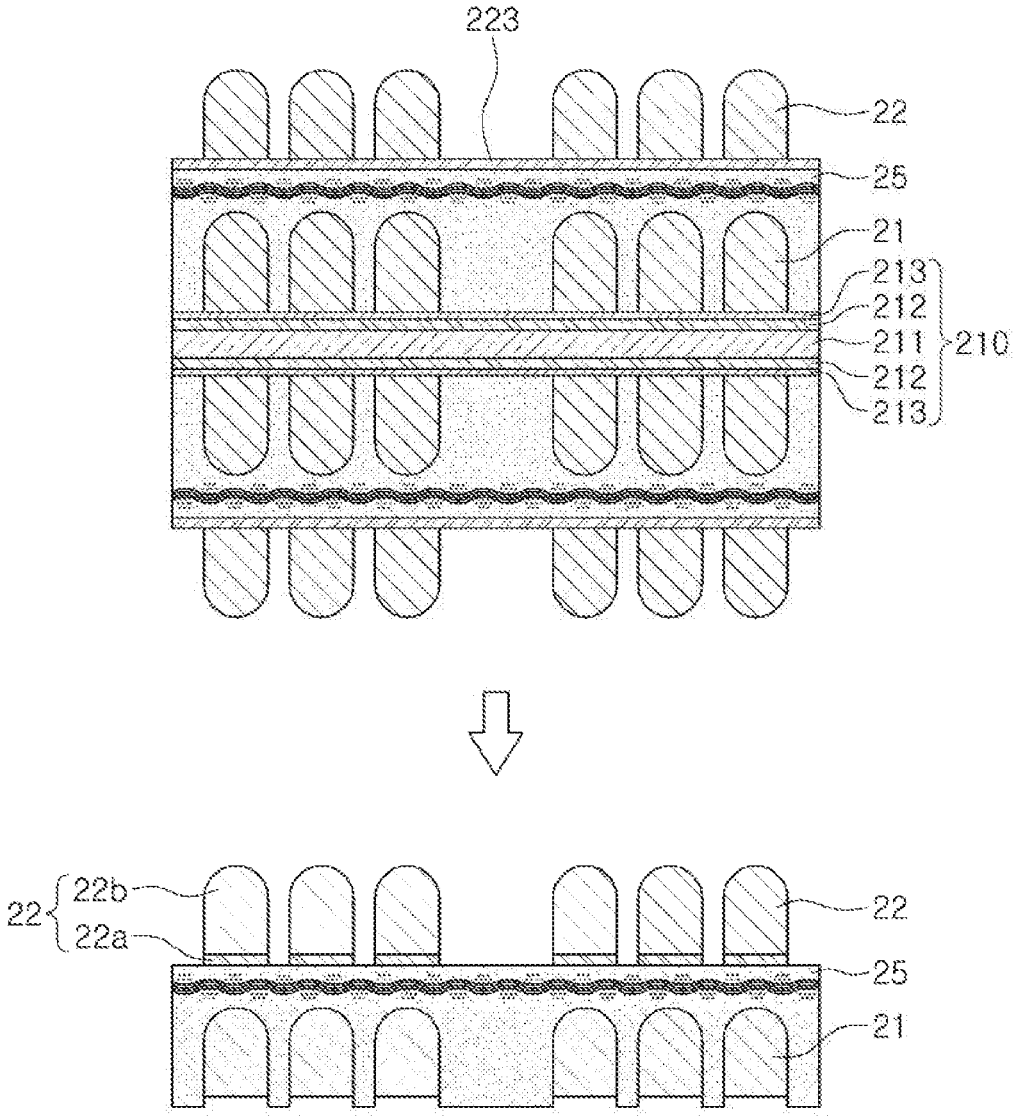
Figure 5C:
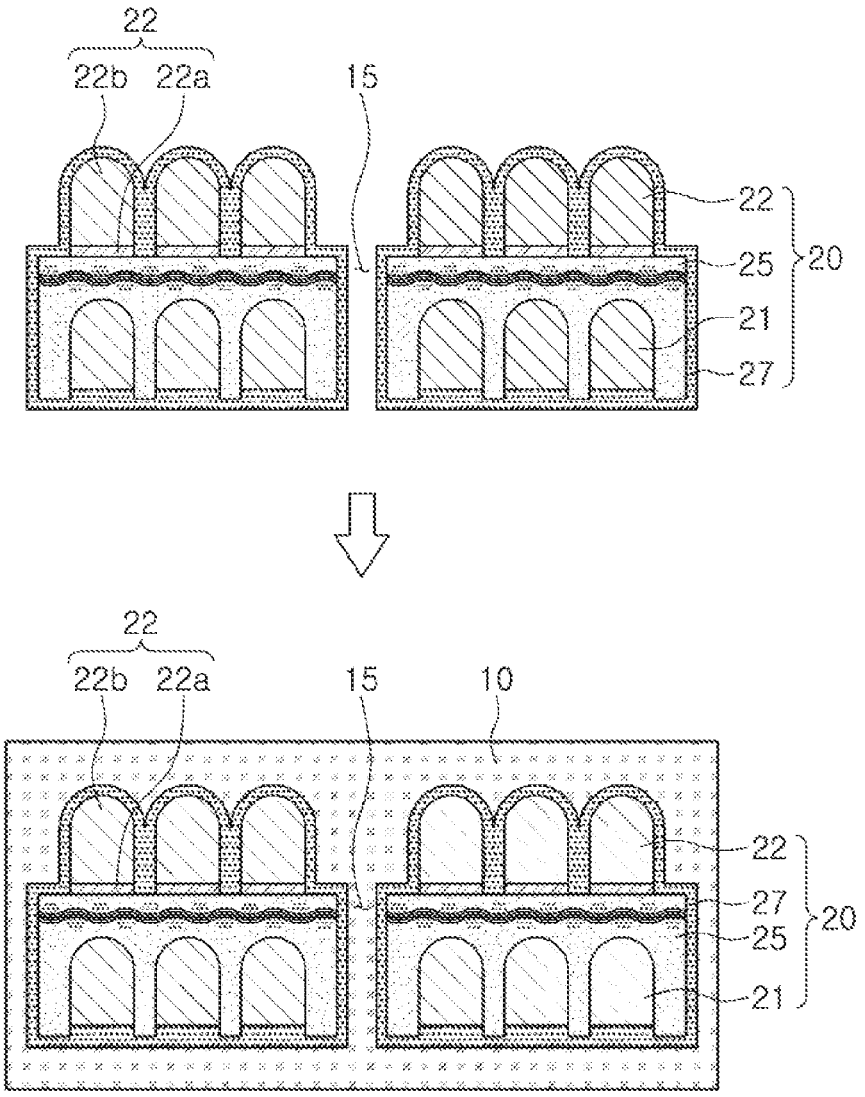

FIGS. 5A through 5C are schematic views illustrating an example of a method for manufacturing the coil component 100A illustrated in FIG. 3.

Referring to FIG. 5A, a substrate 210 may be provided having first and second metal layers 212 and 213 sequentially disposed on a support layer 211. The first and second metal layers 212 and 213 may be disposed on only a surface of the support layer 211, or may alternatively be disposed on both opposing surfaces of the support layer 211 (as shown). The support layer 211 may include an insulating resin, a glass fiber, or an inorganic filler, and the first and second metal layers 212 and 213 may be copper foils, but the present disclosure is not limited thereto. The first and second metal layers 212 and 213 may be bonded to the support layer 211 with an adhesive material such that the first and second metal layers 212 and 213 may be easily separated from the support layer 211. The first metal layer 212 may have a thickness greater than that of the second metal layer 213. The support layer 211 may be a common detach core film (DCF). For example, a seed copper (Cu) layer and a carrier copper (Cu) layer of the CCL may be bonded to the support layer, while being reversed with each other.

Subsequently, the first coil pattern layer 21, having the planar spiral pattern, may be formed on the second metal layer 213 of the substrate 210. The first coil pattern layer 21 may be formed using a known plating technology, for example, a modified semi-additive process (MSAP) or the like, and using the second metal layer 213 as a seed layer. While both isotropic plating and anisotropic plating may be used as the plating method, isotropic plating may be advantageous in terms of controlling (e.g., reducing) plating thickness deviations.

Subsequently, the insulating layer 25, embedding at least a portion of the first coil pattern layer 21, may be formed on the second metal layer 213 of the substrate 210. The insulating layer 25 may be formed using prepreg, having the asymmetric structure, as described above. The insulating layer 25 may be formed using a method for stacking the prepreg having the asymmetric structure on the second metal layer 213 of the substrate 210, such that the first coil pattern layer 21 may be embedded in the lower region of the insulating layer 25, having the thickness t2 greater than the thickness t1 of the upper region thereof. A known method may be used in the stacking process. A third metal layer 223 (see, e.g., FIG. 5B) may be formed on the upper surface of the insulating layer 25. The third metal layer 223 may also be a copper foil, but is not limited thereto.

Referring to FIG. 5B, the second coil pattern layer 22, having the planar spiral pattern, may subsequently be formed on the insulating layer 25 (e.g., on the third metal layer 223 that is formed on the insulating layer 25). The second coil pattern layer 22 may be formed using a known plating technology, for example, a MSAP or the like, and using the third metal layer 223 as a seed layer. While both isotropic plating and anisotropic plating may be used as the plating method, isotropic plating may be advantageous in terms of controlling (e.g., reducing) plating thickness deviations. When forming the second coil pattern layer 22, the via 23 may also be formed.

Subsequently, the first metal layer 212 and the second metal layer 213 may be separated. The separating process may enable the first coil pattern layer 21, the second coil pattern layer 22, the via 23, and the insulating layer 25 that form the coil portion 20 to be separated from the substrate 210. After the separating process, the second metal layer 213, disposed on the lower surface of the first coil pattern layer 21, and the third metal layer 223, disposed on the upper surface of the insulating layer 25, may be removed using a known etching process. As an etching result, the first coil pattern layer 21 may have a structure from which a seed layer is removed, and the second coil pattern layer 22 may have a structure in which a portion of the third metal layer 223 remains as a seed layer. The lower surface of the first coil pattern layer 21 may also be stepped from the lower surface of the insulating layer 25. The third metal layer 223 may also be separately removed using an etching process before the separating process, if necessary.

Referring to FIG. 5C, the core 15, passing through a central portion of the insulating layer 25, may subsequently be formed. The core 15 may be formed using laser drilling and/or mechanical drilling. When a series of processes are performed with the insulating layer 25 having a large size, the insulating layer 25 may be diced and ground into a desired size, if necessary. After forming the core 15, the insulating film 27 may be formed using a known insulation coating process. The insulating film 27 may cover the upper surface and the side surface of the second coil pattern layer 22, and may fill the space between the portions (e.g., between the windings) of the planar spiral pattern of the second coil pattern layer 22. Further, the insulating film 27 may cover the at least a portion of the upper surface, the at least a portion of the side surface, and the at least a portion of the lower surface, of the insulating layer 25. Further, the insulating layer 27 may cover the at least a portion of the lower surface of the first coil pattern layer 21. Here, the insulating layer 27 may fill the recessed region of the lower surface of the first coil pattern layer 21. The coil portion 20 may be formed using the series of processes.

Subsequently, the body portion 10 may be formed by enclosing the coil portion 20 with the magnetic material. The body portion 10 may be formed by stacking and compressing a magnetic sheet, including magnetic metal powder particles and a binder resin, on and below the coil portion 20, but the present disclosure is not limited thereto. After forming the body portion 10, the electrode portion 30 may be formed on the body portion 10. The electrode portion 30 may be formed using a method for sequentially forming a conductive resin layer and a conductive layer on the body portion 10. However, the present disclosure is not limited thereto.

Meanwhile, a method for manufacturing a coil component, according to an exemplary embodiment, is not necessarily limited to the above-described order, and if necessary, an operation disclosed as being performed later may be performed earlier, and an operation described as being performed early may be performed as a subsequent process.

Figure 6:
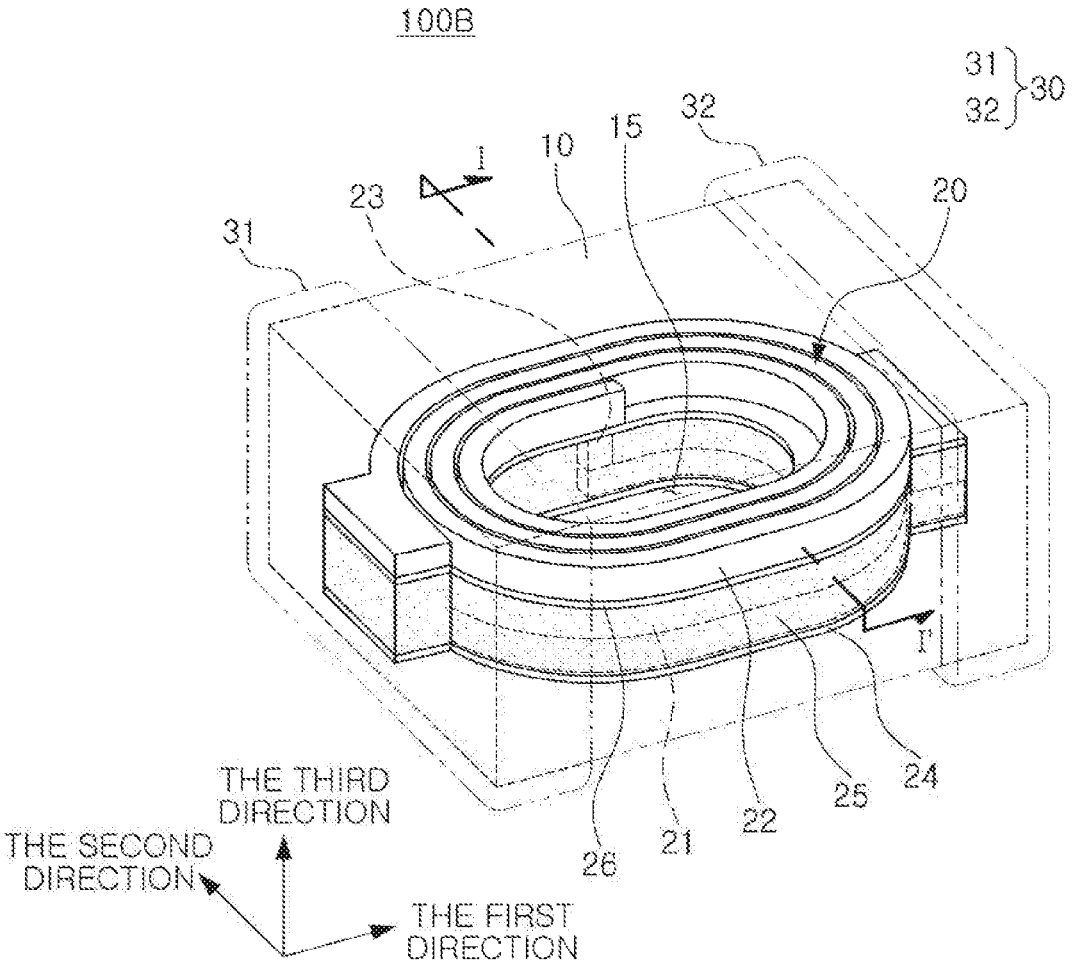
FIG. 6 is a schematic projected perspective view illustrating another example of a coil component.

FIG. 6 is a schematic projected perspective view illustrating another example of a coil component 100B.

Figure 7:
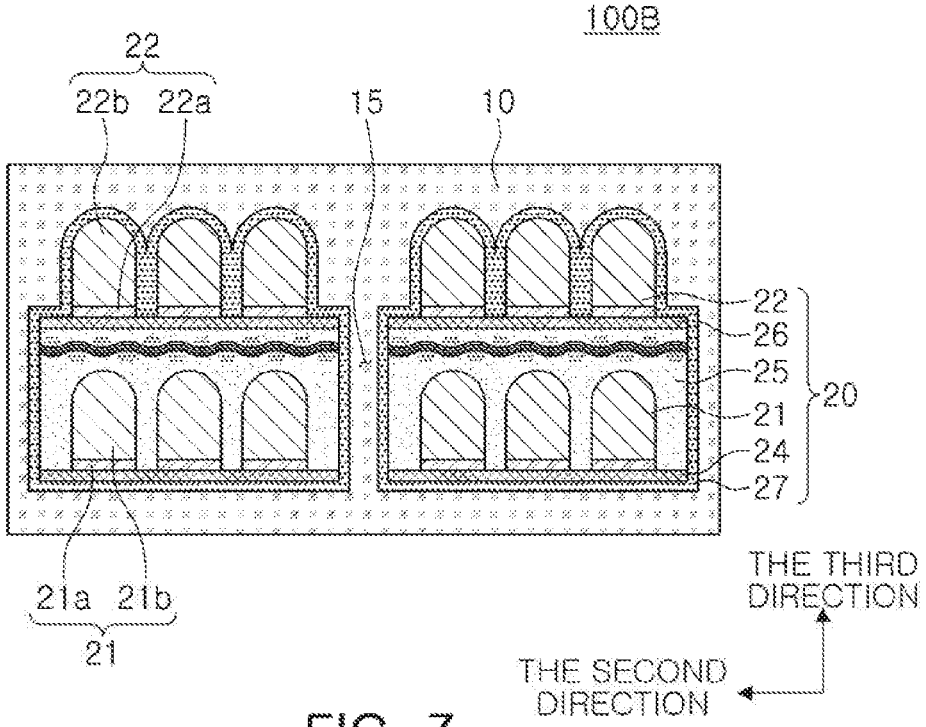
FIG. 7 is a schematic cross-sectional view of the coil component of FIG. 6 taken along line I-I'.

FIG. 7 is a schematic cross-sectional view of the coil component 100B taken along line I-I' of FIG. 6.

Figure 8:
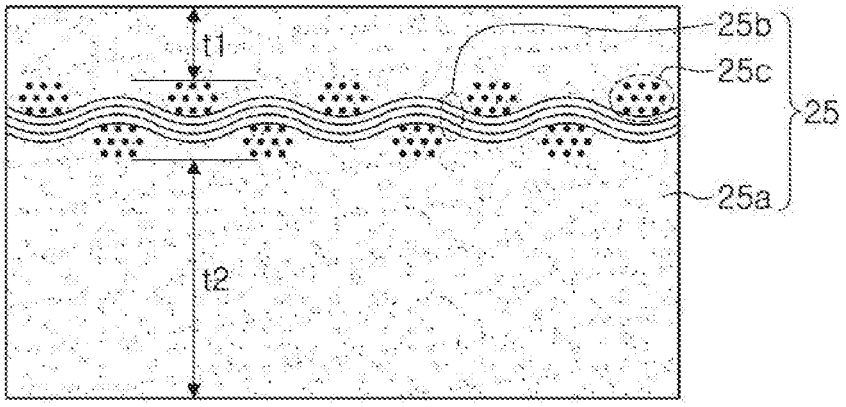
FIG. 8 is a schematic enlarged cross-sectional view of an insulating layer of the coil component of FIG. 7.

FIG. 8 is a schematic enlarged cross-sectional view of an insulating layer of the coil component 100B of FIG. 7.

Referring to FIGS. 6 through 8, a coil component 100B, according to another example, may include a coil portion 20. The coil portion 20 may include a first insulating film 24 disposed below an insulating layer 25, and a second insulating film 26 disposed between the insulating layer 25 and a second coil pattern layer 22. The adoption of the first insulating film 24 and the second insulating film 26 may enable the first coil pattern layer 21 and the second coil pattern layer 22 to be formed using a semi-additive process (SAP). Here, a pitch between coil patterns may be narrowed, and thus even when the coil component is microminiaturized and ultrathinned, the number of turns of the coil may be increased. The first insulating film 24 and the second insulating film 26 may be known insulating films formed of insulating resins. As a non limiting example, the first insulating film 24 and the second insulating film 26 may be Ajinomoto build-up films (ABFs), including insulating resins and inorganic fillers, but are not limited thereto. Surfaces of the first and second insulating films 24 and 25, on which first and second metal primer layers 224 and 226 are disposed (see, e.g., FIG. 9A), may be subjected to surface treatment with a known chemical to create surface roughness. In this case, contact force may be increased.

When the first insulating film 24 and the second insulating film 26 are adopted, the insulating film 27 may cover (and directly contact, for example) at least a portion of a lower surface of the first insulating film 24, at least a portion of a side surface of the insulating layer 25, and at least a portion of an upper surface of the second insulating film 26. Further, the lower surface of the first coil pattern layer 21, exposed from a lower surface of the insulating layer 25, may be covered by the second insulating film 26. The lower surface of the first coil pattern layer 21 and the lower surface of the insulating layer 25 may be on approximately the same level.

Further, when the first insulating film 24 and the second insulating film 26 are adopted, the first coil pattern layer 21 may include a seed layer 21*a* and a plating layer 21*b*. The second coil pattern layer 22 may similarly include a seed layer 22*a* and a plating layer 22*b*. For example, the first coil pattern layer 21 and the second coil pattern layer 22 may be formed using the SAP. Because of using the SAP, when forming the first coil pattern layer 21 and the second coil pattern layer 22, primer-coated copper foils may be attached to the first and second insulating films 24 and 26, respectively, and the first and second insulating films 24 and 26, attached with the primer-coated copper foils, may be used as seed layers. After forming the first coil pattern layer 21 and the second coil pattern layer 22 using the respective primer-coated copper foils as the seed layers, the primer-coated copper foils may be removed using an etching process. After the etching process, the primer-coated copper foils may remain as the seed layers 21*a* and 22*a* below the first and second coil pattern layers 21 and 22, respectively.

A description of other configurations and a manufacturing method except for the above-mentioned configuration is substantially the same as that described in an exemplary embodiment of the coil component 100A, and is thus omitted.

Figure 9A:
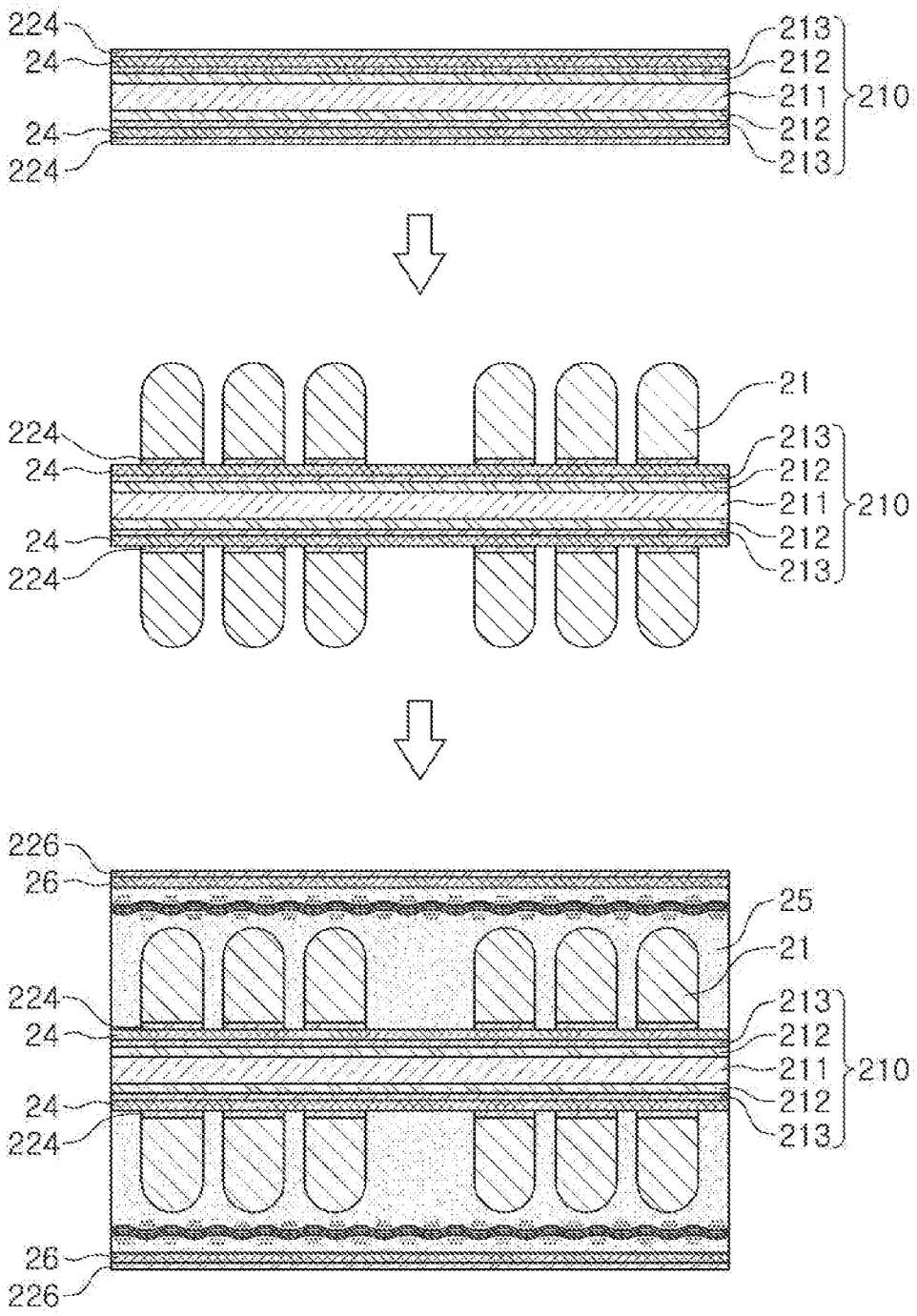
FIGS. 9A through 9C are schematic views illustrating sequential steps of a method for manufacturing the coil component illustrated in FIG. 7.
Figure 9B:
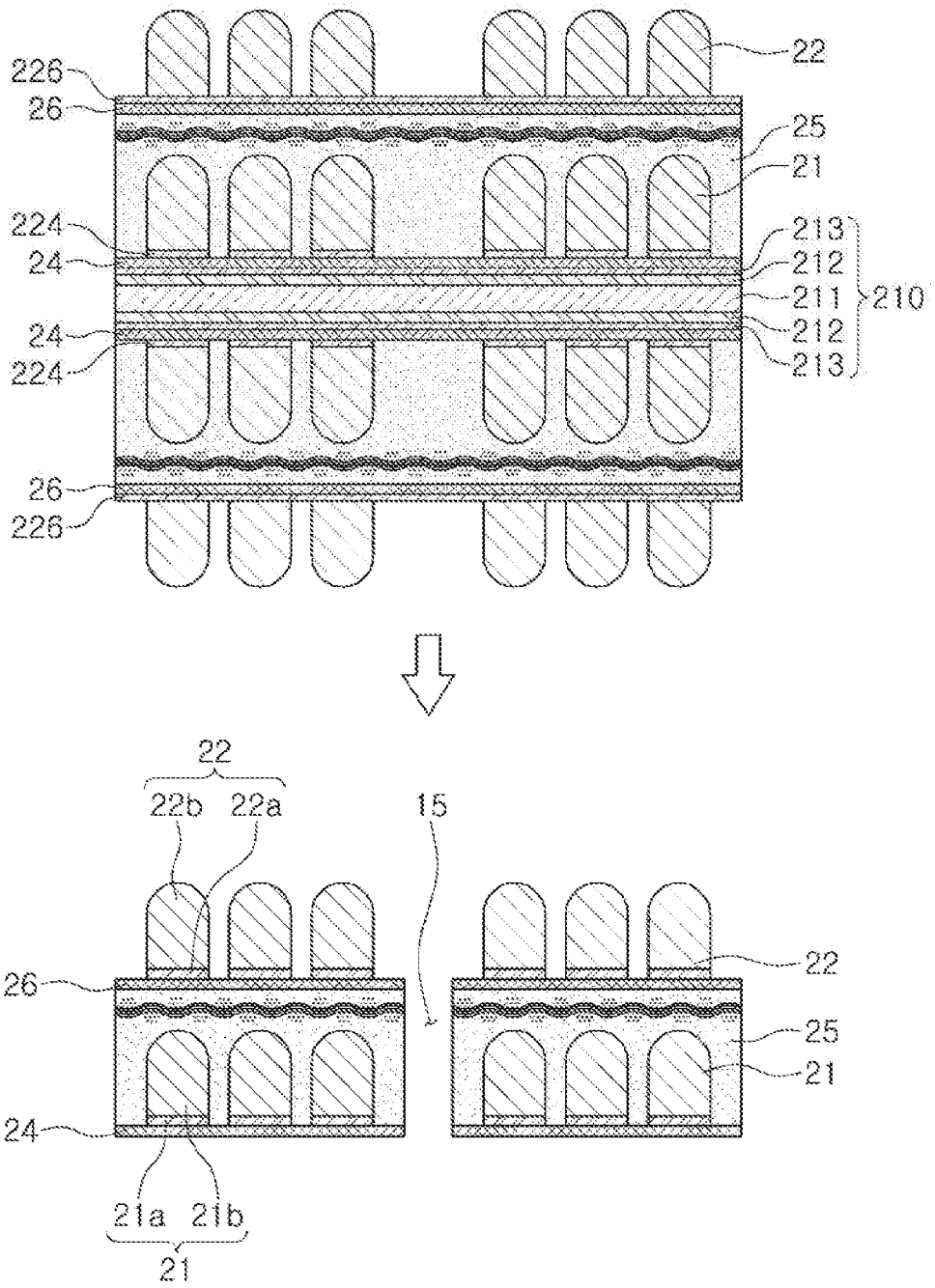
Figure 9C:
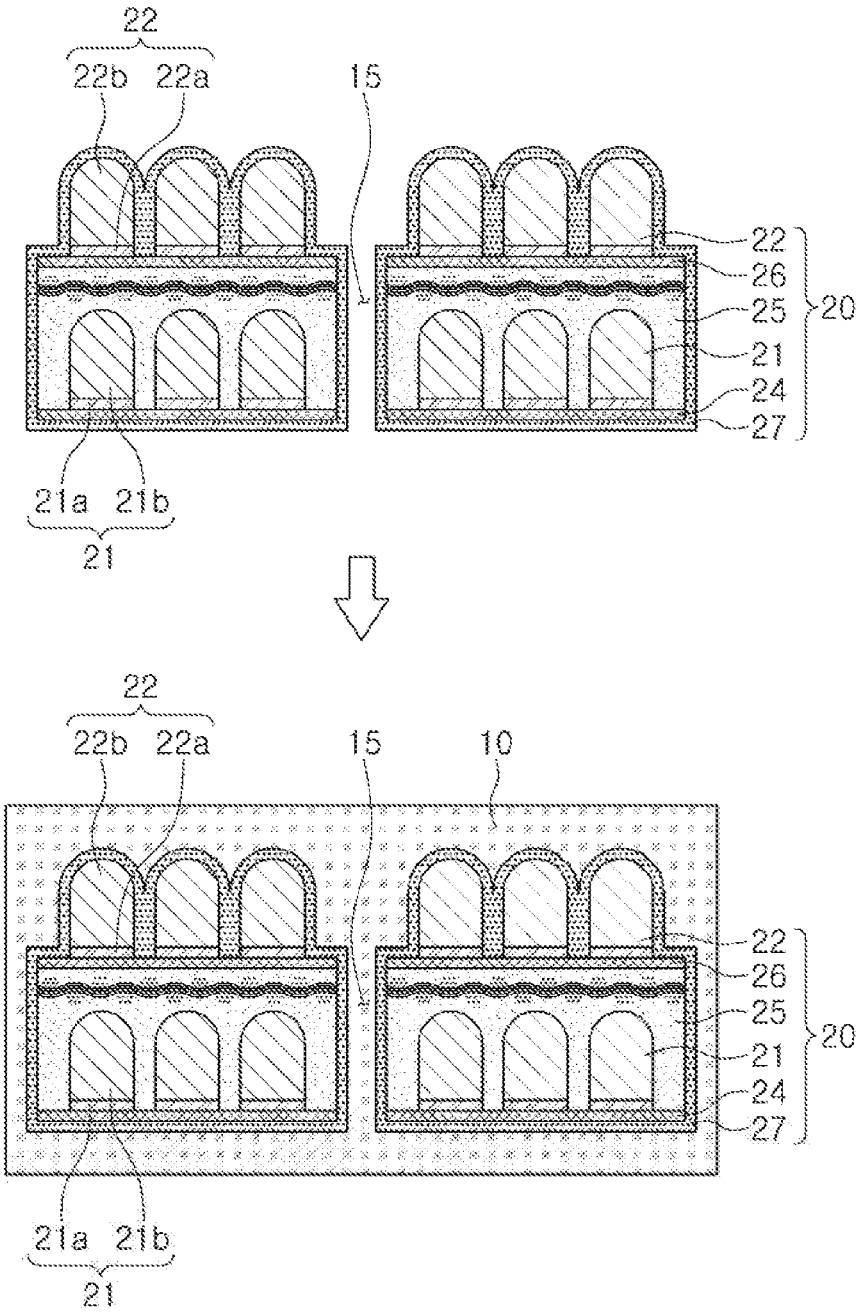

FIGS. 9A through 9C are schematic views illustrating steps of a method for manufacturing the coil component 100B illustrated in FIG. 7.

Referring to FIG. 9A, a substrate 210, having first and second metal layers 212 and 213 sequentially disposed thereon, may be provided first on a support layer 211. A first insulating film 24 may be stacked on the second metal layer 213 of the substrate 210. The first and second metal layers 212 and 213 and the first insulating film 24 may be disposed on only one surface of the support layer 211, or may alternatively be disposed on both opposing surfaces of the support layer 211. The support layer 211 may be a common DCF and the first insulating film 24 may be an ABF, but the present disclosure is not limited thereto. A first metal primer layer 224, such as a known primer-coated copper foil, may be disposed on the first insulating film 24.

Subsequently, a first coil pattern layer 21, having a planar spiral shape, may be formed on the first insulating film 24 disposed on the second metal layer 213 of the substrate 210. The first coil pattern layer 21 may be formed using a known plating technology, for example, a SAP or the like, and using the first metal primer layer 224, attached to the first insulating film 24, as a seed layer. While both isotropic plating and anisotropic plating may be used as the plating method, isotropic plating may be advantageous in terms of controlling (e.g., reducing) plating thickness deviations. After forming the first coil pattern layer 21, the first metal primer layer 224 may be removed using an etching process. After the etching process, the first coil pattern layer 21 may include a seed layer 21*a* and a plating layer 21*b*.

Subsequently, the insulating layer 25, embedding at least a portion of the first coil pattern layer 21, may be formed on the first insulating film 24 disposed on the second metal layer 213 of the substrate 210. The insulating layer 25 may be the PPG having the asymmetric structure as described above. The stacking process may use a known method. A second insulating film 26 may be stacked on the insulating layer 25. A second metal primer layer 226, such as a known primer-coated copper foil, may be disposed on the second insulating film 26.

Referring to FIG. 9B, a second coil pattern layer 22, having a planar spiral pattern, may be subsequently formed on the second insulating film 26 disposed on the insulating layer 25. The second coil pattern layer 22 may be formed using a known plating technology, for example, a MSAP or the like, and using the second metal primer layer 226 as a seed layer. While both isotropic plating and anisotropic plating may be used as the plating method, isotropic plating may be advantageous in terms of plating thickness deviations. When forming the second coil pattern layer 22, a via 23 may also be formed.

Subsequently, the first metal layer 212 and the second metal layer 213 may be separated. The separating process may enable the first coil pattern layer 21, the second coil pattern layer 22, the via 23, the first insulating film 24, the insulating layer 25, and the second insulating film 26 that form a coil portion 20 to be separated from the substrate 210. After the separating process, the second metal layer 213, disposed on a lower surface of the first insulating film 24, and the second metal primer layer 226, disposed on an upper surface of the second insulating film 26, may be removed using an etching process. After the etching process, the second coil pattern layer 22 may include a seed layer 22*a* and a plating layer 22*b*. The second metal primer layer 226 may also be etched separately, prior to the separating process, if necessary.

Referring to FIG. 9C, a core 15, passing through central portions of the first insulating film 24, the insulating layer 25, and the second insulating film 26, may subsequently be formed. The core 15 may be formed using laser drilling and/or mechanical drilling. When a series of processes are performed with the insulating layer 25 having a large size, the insulating layer 25 may be diced and ground into a desired size, if necessary. After forming the core 15, an insulating film 27 may be formed using a known insulation coating process. The coil portion 20 may be formed using the series of processes. The insulating film 27 may cover an upper surface and a side surface of the second coil pattern layer 22, and may fill a space between portions of a planar spiral pattern of the second coil pattern layer 22. Further, the insulating film 27 may cover at least a portion of each of an upper surface, a side surface, and a lower surface of the insulating layer 25. Further, the insulating film 27 may cover at least a portion of the lower surface of the first insulating film 24, at least a portion of the side surface of the insulating layer 25, and at least a portion of the upper surface of the second insulating film 26. Further, the lower surface of the first coil pattern layer 21, exposed from the lower surface of the insulating layer 25, may be covered by the first insulating film 24.

Subsequently, the body portion 10 may be formed by enclosing the coil portion 20 with a magnetic material. The body portion 10 may be formed by stacking and compressing a magnetic sheet, including magnetic metal powder particles and a binder resin, on and below the coil portion 20, but the present disclosure is not limited thereto. After forming the body portion 10, an electrode portion 30 may be formed on the body portion 10. The electrode portion 30 may be formed using a method for sequentially forming a conductive resin layer and a conductive layer on the body portion 10. However, the present disclosure is not limited thereto.

Meanwhile, a method for manufacturing a coil component, according to an exemplary embodiment, is not necessarily limited to the above-described ordering of steps. If necessary, an operation disclosed as being performed later may be conducted earlier, and an operation described as being performed early may be conducted as a subsequent process or step.

A description of other configurations and a manufacturing method except for the above-mentioned configuration is substantially the same as that described in an exemplary embodiment of the coil component 100A, and is thus omitted.

Figure 10:
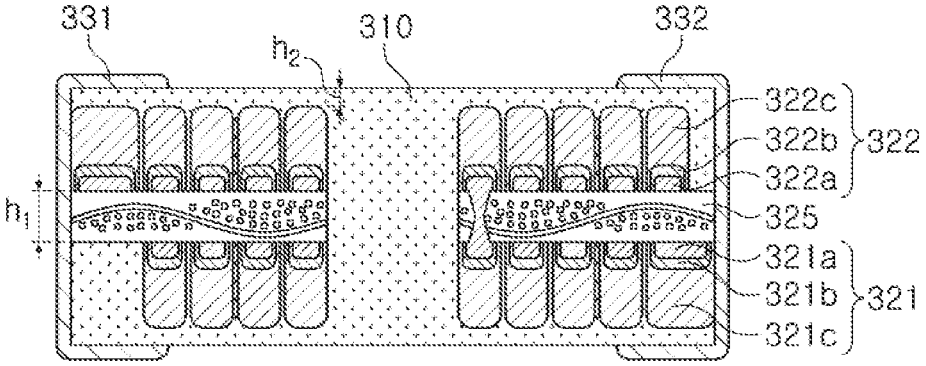
FIG. 10 is a schematic cross-sectional view illustrating an example of a coil component to which a thin film technology according to the related art is applied.

FIG. 10 is a schematic cross-sectional view illustrating an example of a coil component to which a thin film technology, according to the related art, is applied.

The coil component, to which the thin film technology, according to the related art, is applied, may be manufactured by, for example, forming patterns 321*a*, 321*b*, 321*c*, 322*a*, 322*b*, and 322*c*, each having a planar coil shape, on opposing surfaces of a support member 325 and forming a via (not illustrated), using the thin film technology, embedding the patterns 321*a*, 321*b*, 321*c*, 322*a*, 322*b*, and 322*c* and the via with a magnetic material to form a body 310. External electrodes 331 and 332 are formed to be electrically connected to the patterns 321*a*, 321*b*, 321*c*, 322*a*, 322*b*, and 322*c* outside the body 310. However, as mentioned above, the coil component, to which the thin film technology is applied, may have a considerable height $h_1$ of the support member 325. Thus, there may be limitations on a height $h_2$ of the magnetic material disposed on and below the patterns 321*a*, 321*b*, 321*c*, 322*a*, 322*b*, and 322*c*. As a result, there may be a limit in providing high capacity.

As set forth above, according to an exemplary embodiment, there may be provided a coil component that may maintain improved rigidity, while ensuring a sufficient thickness of a magnetic material covering a coil, regardless of miniaturization and thinning of the coil component, and a method for manufacturing the coil component.

While exemplary embodiments have been shown and described above, it will be apparent to those skilled in the art that modifications and variations could be made without departing from the scope of the present disclosure, as defined by the appended claims.

What is claimed is:

1. A coil component comprising:

a body portion including a magnetic material; and a coil portion disposed in the body portion, wherein the coil portion includes a first coil pattern layer having a planar spiral pattern, an insulating layer forming of an insulating resin embedding at least a portion of the first coil pattern layer, and a second coil pattern layer disposed on the insulating layer and having a planar spiral pattern, and the insulating layer includes a core material disposed between the first and second coil pattern layers, and a thickness of a lower region of the insulating layer disposed below the core material is greater than a thickness of an upper region of the insulating layer disposed above the core material.

2. The coil component of claim 1, wherein the first coil pattern layer is embedded in the lower region of the insulating layer, and the second coil pattern layer is disposed on the upper region of the insulating layer.

3. The coil component of claim 1, wherein the insulating layer includes a glass fiber as the core material.

4. The coil component of claim 3, wherein the insulating layer further includes an inorganic filler.

5. The coil component of claim 1, wherein the coil portion further includes an insulating film covering an upper surface and a side surface of the second coil pattern layer, while filling a space between portions of the planar spiral pattern of the second coil pattern layer.

6. The coil component of claim 5, wherein the insulating film covers at least a portion of an upper surface of the insulating layer, at least a portion of a lower surface of the insulating layer, and at least a portion of a side surface of the insulating layer.

7. The coil component of claim 6, wherein a lower surface of the first coil pattern layer is exposed from the lower surface of the insulating layer, and the exposed lower surface of the first coil pattern layer is covered by the insulating film.

8. The coil component of claim 1, wherein the first coil pattern layer includes a plating layer without having a seed layer, and the second coil pattern layer includes a seed layer and a plating layer.

9. The coil component of claim 8, wherein a lower surface of the first coil pattern layer is stepped from a lower surface of the insulating layer.

10. The coil component of claim 1, wherein the coil portion further includes:

a first insulating film disposed below the insulating layer; and a second insulating film disposed between the insulating layer and the second coil pattern layer.

11. The coil component of claim 10, wherein the coil portion further includes:

an insulating film covering an upper surface and a side surface of the second coil pattern layer, while filling a space between portions of the planar spiral pattern of the second coil pattern layer.

12. The coil component of claim 11, wherein the insulating film covers at least a portion of a lower surface of the first insulating film, at least a portion of a side surface of the insulating layer, and at least a portion of an upper surface of the second insulating film.

13. The coil component of claim 10, wherein a lower surface of the first coil pattern layer is exposed from a lower surface of the insulating layer, and the exposed lower surface of the first coil pattern layer is covered by the first insulating film.

14. The coil component of claim 10, wherein the first coil pattern layer and the second coil pattern layer each include a seed layer and a plating layer.

15. A method for manufacturing a coil component, the method comprising:

providing a substrate including a support layer having a first metal layer and a second metal layer sequentially disposed thereon;

forming a first coil pattern layer having a planar spiral pattern on the second metal layer of the substrate;

forming an insulating layer on the second metal layer of the substrate, the insulating layer embedding at least a portion of the first coil pattern layer;

forming a second coil pattern layer having a planar spiral pattern on the insulating layer;

separating the first metal layer from the second metal layer having the first coil pattern layer, the insulating layer, and the second coil pattern layer thereon;

removing the second metal layer from the first coil pattern layer, the insulating layer, and the second coil pattern layer; and enclosing the first coil pattern layer, the second coil pattern layer, and the insulating layer with a magnetic material, wherein the insulating layer includes a core material disposed between the first and second coil pattern layers, and a thickness of a lower region of the insulating layer disposed below the core material is greater than a thickness of an upper region of the insulating layer disposed above the core material.

16. The method of claim 15, wherein the first coil pattern layer is embedded in the lower region of the insulating layer, and the second coil pattern layer is formed in the upper region of the insulating layer.

17. A coil component comprising:

a first coil pattern, layer having a planar spiral pattern;

an insulating layer having the first coil pattern layer embedded therein, wherein the insulating layer includes insulating resin having a core material disposed therein extending in a plane substantially parallel to the planar spiral pattern; and a second coil pattern layer having a planar spiral pattern and disposed on a surface of the insulating layer to be substantially parallel to the planar spiral pattern, wherein a thickness of a lower region of the insulating layer disposed below the core material and a thickness of an upper region of the insulating layer disposed above the core material are different.

18. The coil component of claim 17, wherein the core material has a higher rigidity than the insulating resin disposed above and below the core material.

19. The coil component of claim 18, wherein the core material includes a glass fiber.

20. The coil component of claim 17, wherein the core material is disposed above the first coil pattern layer in the insulating layer, and the thickness of the lower region is larger than the thickness of the upper region.

21. The coil component of claim 20, further comprising:

an insulating film disposed on upper and side surfaces of the second coil pattern layer and between windings of the second coil pattern layer, disposed on upper, side, and lower surfaces of the insulating layer, and disposed on lower surfaces of the first coil pattern layer exposed through the lower surface of the insulating layer; and a magnetic body including a magnetic material and having the first coil pattern layer, the insulating layer, the second coil pattern layer, and the insulating film embedded therein.

22. A coil component comprising:

an insulating layer formed of an insulating resin and having a substantially planar core material embedded therein;

a first coil pattern layer disposed on a first side of the core material, having a planar spiral pattern, and embedded in the insulating layer to have the insulating resin extending between windings of the planar spiral pattern; and a second coil pattern layer having a planar spiral pattern disposed on a surface of the insulating layer on a second side of the core material opposite to the first side, wherein a thickness of a lower region of the insulating layer disposed below the core material and a thickness of an upper region of the insulating layer disposed above the core material are different.

23. The coil component of claim 22, further comprising:

an insulating film disposed on surfaces of the second coil pattern layer including between windings of the planar spiral pattern of the second coil pattern layer, disposed on surfaces of the insulating layer, and disposed to contact surfaces of the first coil pattern layer exposed through the insulating layer.

24. The coil component claim 23, further comprising:

a body including a magnetic material disposed on surfaces of the insulating film to have the insulating layer, the first coil pattern layer, the second coil pattern layer, and the insulating film embedded therein.

25. The coil component claim 22, wherein the core material has a higher rigidity than the insulating resin of the insulating layer.

26. The coil component of claim 22, wherein the core material includes a glass fiber.

* * * * *